US007463212B1

(12) United States Patent
Ziolkowski

(10) Patent No.: US 7,463,212 B1
(45) Date of Patent: Dec. 9, 2008

(54) LIGHTWEIGHT C-SANDWICH RADOME FABRICATION

(75) Inventor: Fred Ziolkowski, Medway, MA (US)

(73) Assignee: Radant Technologies, Inc., Stow, MA (US)

( * ) Notice: Subject to any disclaimer, the term of this patent is extended or adjusted under 35 U.S.C. 154(b) by 0 days.

(21) Appl. No.: 11/434,052

(22) Filed: May 15, 2006

Related U.S. Application Data

(63) Continuation of application No. 11/226,134, filed on Sep. 14, 2005, now abandoned.

(51) Int. Cl.
*H01Q 1/42* (2006.01)

(52) U.S. Cl. ..... 343/872

(58) Field of Classification Search ..... 343/872, 343/873

See application file for complete search history.

(56) References Cited

U.S. PATENT DOCUMENTS 3,235,441 A * 2/1966 George, Jr. et al. ..... 428/35.8
3,367,766 A * 2/1968 Bergmann et al. ..... 423/291
4,212,014 A 7/1980 Chekroun
4,297,708 A 10/1981 Vidal
4,320,404 A 3/1982 Chekroun
4,344,077 A 8/1982 Chekroun et al.
4,433,313 A 2/1984 Saint et al.
4,447,815 A 5/1984 Chekroun et al.
4,467,330 A 8/1984 Vidal et al.
4,506,269 A * 3/1985 Greene ..... 343/872
4,518,966 A 5/1985 Sadones
4,531,126 A 7/1985 Sadones
4,552,151 A 11/1985 Bolomey et al.
4,656,487 A 4/1987 Sureau et al.
4,684,954 A 8/1987 Sureau et al.
4,864,321 A 9/1989 Sureau
5,001,495 A 3/1991 Chekroun
5,081,465 A 1/1992 Collignon
5,144,327 A 9/1992 Chekroun et al.
5,237,328 A 8/1993 Dorey et al.
5,408,244 A * 4/1995 Mackenzie ..... 343/872
5,574,471 A 11/1996 Sureau
5,579,015 A 11/1996 Collignon
5,579,024 A 11/1996 Sureau
5,598,172 A 1/1997 Chekroun
5,621,423 A 4/1997 Sureau
6,107,976 A * 8/2000 Purinton ..... 343/872

OTHER PUBLICATIONS

R.H.J. Cary, *Radomes, in* The Handbook of Antenna Design, vol. 2, Chapter 14, (A. W. Rudge et al. eds., 1983). Peter Peregrinus Ltd. on behalf of the Institution of Electrical Engineers, London, UK (pp. 457-552).

(Continued)

*Primary Examiner*—Michael C Wimer
(74) *Attorney, Agent, or Firm*—Iandiorio Teska & Coleman

(57) ABSTRACT

A C-sandwich radome structure includes a first core, an outer skin layer on the first core, a second core, and an inner skin layer on the second core. An intermediate skin layer is disposed between the first core and the second core and the intermediate skin layer includes a dielectric enhancer for raising the dielectric constant of the intermediate skin layer so the intermediate skin layer can be made thinner to reduce the weight and cost of the structure while maintaining the electrical transmission performance of a thicker, heavier intermediate skin layer.

43 Claims, 3 Drawing Sheets

OTHER PUBLICATIONS

Skolnik, M.I., Introduction to Radar Systems, Chapter 7, (1980, 2nd Edition) McGraw-Hill, Inc., New York, NY, pp. 264-269.

Publication entitled "Skolnik Radar Handbook," Ch. 14, sections 14.1-14.3, pp. 14-2-14-21, date unknown.

* cited by examiner

LIGHTWEIGHT C-SANDWICH RADOME FABRICATION

RELATED APPLICATIONS

This application is a continuation of U.S. patent application Ser. No. 11/226,134, filed on Sep. 14, 2005 now abandoned, entitled "LIGHTWEIGHT C-SANDWICH RADOME FABRICATION", which is incorporated by reference herein.

FIELD OF THE INVENTION

This subject invention relates to radomes.

BACKGROUND OF THE INVENTION

Radomes function to protect antennas such as radar and other antennas and associated equipment from environmental exposure and thus must exhibit suitable structural integrity, be capable of surviving thermal and other stresses, and, in the case of aircraft radomes, be aerodynamic in design. Radomes must also be constructed to achieve certain desired electrical performance characteristics. Electrical considerations include minimum transmission loss, minimum reflected power, minimum beam deflection, and minimum pattern distortion. Typically, there is a trade-off in the design of a radome as between structural/environmental and electrical considerations.

There are many different materials used in constructing radomes and many different cross sectional configurations including single layer (typically made of a composite material), A-sandwich, B-sandwich, C-sandwich, and multiple-layer sandwich constructions. See Rudge, A. W., K. Miene, A. D. Oliver, and P. Knight, *The Handbook of Antenna Design*, Vol. 2, Chapter 14, Peter Peregrenus Ltd., London, UK and Skolnik, M. I., *Introduction to Radar Systems*, Chapter 7, McGraw-Hill, New York, N.Y., both incorporated herein by this reference.

In a typical C-sandwich radome structure, there are two honeycomb or other low density core layers separated by a central skin layer and also a skin layer on the outside of each core forming the interior and exterior of the radome.

For electrical reasons, the equivalent lumped circuit susceptance of the central skin layer typically is made to be about twice the susceptance of the outside and inside skin layers. The susceptance of each skin layers is a function of the dielectric constant of the material of the skin layer, its thickness, and the frequency of interest.

In the known prior art, the same material was used for all three skin layers and thus they each had the same dielectric constant. In order for the radome to function electrically by maintaining transparency over a range of frequencies and incident angles, the central skin layer typically has twice the susceptance of the inner and outer skin layers. When all the skin layers are made of the same material, the central skin layer is typically twice as thick as the inner and outer skin layers.

In many radome applications, such as an airborne applications, weight is a critical factor and thus those skilled in the art have long sought various weight reduction techniques while still maintaining the desired electrical characteristics and also maintaining the desired structural integrity of the radome structure.

SUMMARY OF THE INVENTION

It is therefore an object of this invention to provide a C-sandwich radome structure which weighs less than prior art C-sandwich radome structures.

It is a further object of this invention to provide such a C-sandwich radome structure which, although lighter, still exhibits good electrical properties and structural integrity.

It is a further object of this invention to provide such a C-sandwich radome structure which is less costly to fabricate.

It is a further object of this invention to provide, in one embodiment, such a C-sandwich radome structure in which the central or intermediate skin layer is thinner than the inner and outer skin layers and yet it still exhibits a susceptance approximately twice the susceptance of the inner and outer skin layers.

The subject invention results from the realization that the intermediate skin layer of a C-sandwich radome structure can be made thinner and thus lighter but still have the desired susceptance by raising the dielectric constant of the intermediate skin layer. Typically, for a composite material intermediate skin layer, high dielectric powders are added to the resin of the composite material to increase the dielectric constant of the resulting intermediate (e.g., central) skin layer. Alternatively, or in addition, a high dielectric fabric can be employed in the intermediate skin layer.

The subject invention, however, in other embodiments, need not achieve all these objectives and the claims hereof should not be limited to structures or methods capable of achieving these objectives.

This subject invention features a C-sandwich radome structure comprising a first core, an outer skin layer on the first core, a second core, and an inner skin layer on the second core. There is an intermediate skin layer between the first core and the second core and the intermediate skin layer includes a dielectric enhancer for raising the dielectric constant of the intermediate skin layer so the intermediate skin layer can be made thinner to reduce the weight of the structure.

Typically, the intermediate skin layer includes a resin and the dielectric enhancer includes high dielectric powders in the resin. The resin may be an epoxy, cyanate ester, or bismaleimide and the ceramic powders may be titanium dioxide, strontium titanate, barium titanate, or others.

Typically, the intermediate skin layer further includes reinforcement such as at least one woven fabric ply made of glass fibers, for example. Typically, the intermediate skin layer is between 10 to 20 mils in thickness and is less thick than the inner skin layer and the outer skin layer. In one example, the outer skin layer and the inner skin layer each have a thickness t and the intermediate skin has a thickness approximately t/2. Preferably, the intermediate skin layer has a dielectric constant of between 8 to 14, e.g., approximately 11.

In one example, the first and second cores comprise honeycomb material and each have a thickness of approximately ¼ the wavelength of a frequency of interest. The outer and inner skin layers typically each comprise plies of woven fabric in a resin matrix and there may be between 2 to 4 plies. The resin may be an epoxy, cyanate ester, or bismaleimide. Typically, the outer and inner skin layers each have a dielectric constant of between 2 to 5, e.g., approximately 3.5. The outer and inner skin layers may have a thickness of between 10 to 30 mils, e.g., 20 mils.

One C-sandwich radome structure in accordance with this invention features a first core, an outer skin layer on the first core having a thickness t and a dielectric constant resulting in a susceptance b, a second core, and an inner skin layer on the second core having the same thickness t and a dielectric constant resulting in the same susceptance b. An intermediate skin layer is disposed between the first core and the second core and has a susceptance of approximately twice b but a thickness less than or equal to t.

An example of a C-sandwich radome structure in accordance with this invention features a first core, an outer skin layer on the first core, a second core, and an inner skin layer on the second core. A resin based intermediate skin layer is disposed between the first core and the second core and preferably includes high dielectric powders therein for raising the dielectric constant of the intermediate skin layer so the intermediate skin layer can be made thinner to reduce the weight of the structure.

The subject invention also features a method of making a C-sandwich radome structure. The method includes forming an intermediate skin layer to include a dielectric enhancer, placing the intermediate skin layer between a first core and a second core, and assembling an outer skin layer onto the first core and an inner skin layer onto the second core. Preferably, the intermediate skin layer is made to have a susceptance approximately twice the susceptance of the inner skin layer and the outer skin layer but with a thickness less than or equal to the thickness of the inner skin layer and the outer skin layer. Typically, the intermediate skin layer includes a resin and the dielectric enhancer includes high dielectric powders disposed in the resin. In one example, the intermediate skin layer further includes at least one woven fabric ply impregnated with the resin. The woven fabric ply may be made of glass fibers.

Typically, the intermediate skin layer is between 10 to 20 mils in thickness but is preferably less thick than the inner skin layer and the outer skin layer. Preferably, the outer skin layer and the inner skin layer each have a thickness t and the intermediate skin layer has a thickness approximately t/2. The intermediate skin layer may have a dielectric constant of between 8 to 14, e.g., approximately 11.

Typically, the first and second cores each comprise honeycomb material and each have a thickness of approximately ¼ the wavelength of a frequency of interest. The outer and inner skin layers typically each comprise plies of woven fabric in a resin matrix. There may be between 2 to 4 plies in each of the outer and inner skin layers. In one embodiment, the outer and inner skin layers each have a dielectric constant of between 2 to 5, e.g., approximately 3.5. The outer and inner skin layers may have a thickness of between 10 to 30 mils, e.g., approximately 20 mils.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
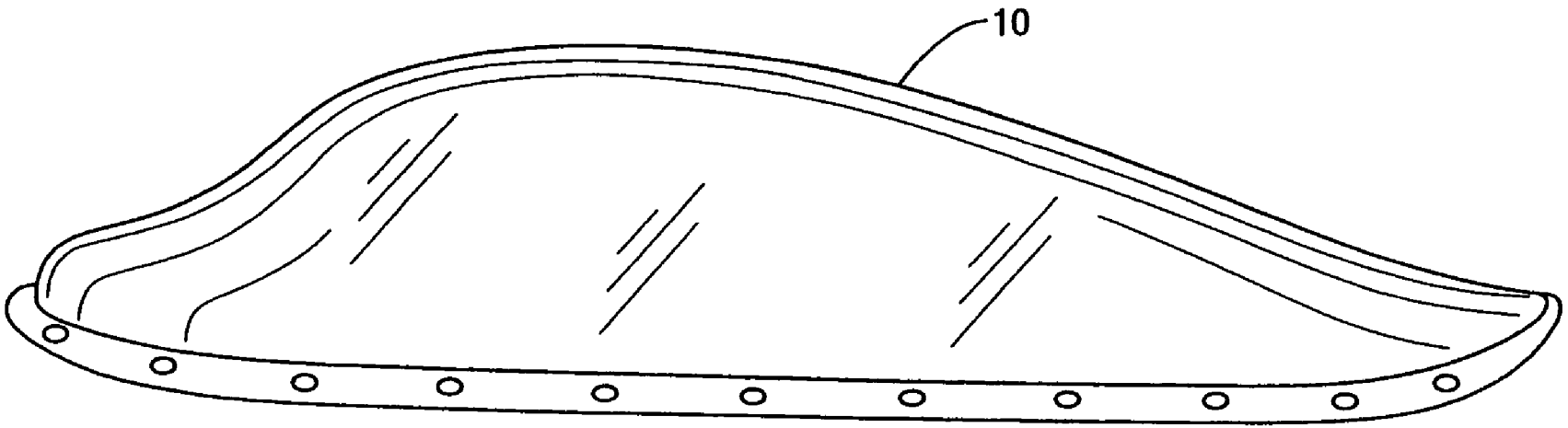
FIG. 1 is a schematic three-dimensional view showing an example of a C-sandwich radome in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
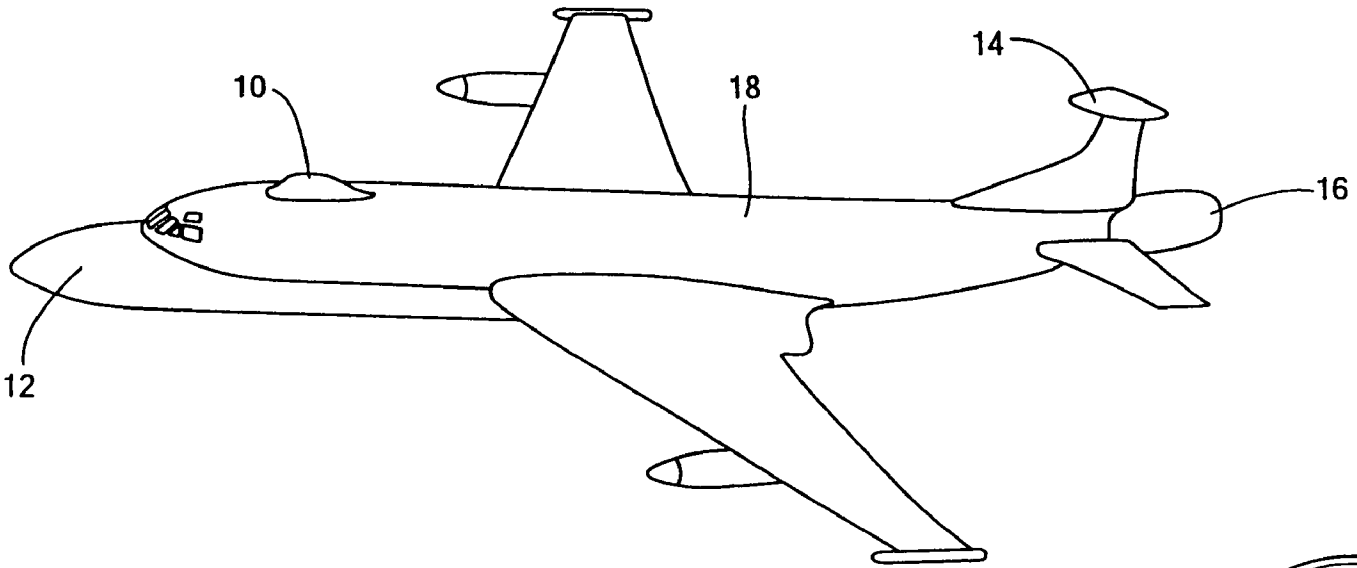
FIG. 2 is a schematic view showing an aircraft with a number of radomes affixed thereto which can be C-sandwich in construction in accordance with the subject invention.
Figure 3:
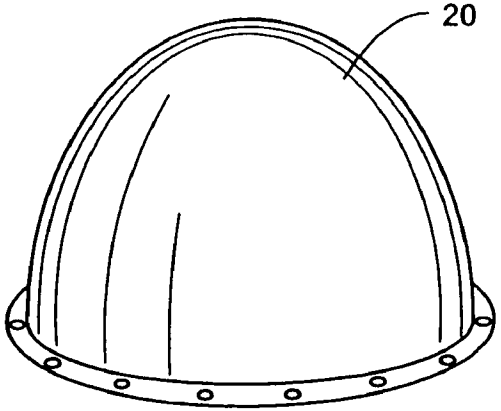
FIG. 3 is a schematic three-dimensional view showing another type of C-sandwich radome in accordance with the subject invention typically used for ship or vehicle based applications or as a ground based installation.

FIG. 1 shows an example of a C-sandwich radome structure 10 in accordance with the subject invention for an aircraft. FIG. 2 shows radome 10 and other radomes 12, 14, and 16 on aircraft 18. Many radome shapes are possible in accordance with the subject invention and FIG. 3 shows a more typical ground, vehicle or ship based radome 20 also in accordance with the subject invention.

As explained in the background section above, radomes protect antennas and other associated equipment from environmental exposure and, at the same time, must also exhibit desirable electrical performance characteristics.

Figure 4:
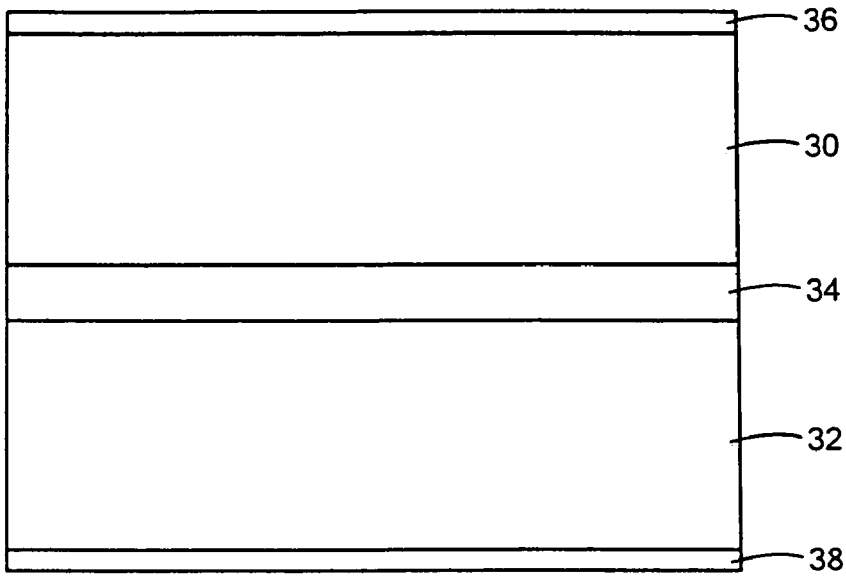
FIG. 4 PRIOR ART
FIG. 4 is a highly schematic cross-sectional view of a typical prior art C-sandwich radome structure wall.

FIG. 4, which is highly schematic and not to scale, shows in cross section a prior art C-sandwich radome structure with first core 30, second core 32, intermediate skin layer 34, outer (e.g., exterior) skin layer 36, and inner (e.g., interior) skin layer 38. As explained in the Background section above, intermediate skin layer 34 is typically made twice as thick as each of inner and outer skin layers 36 and 38 so that intermediate skin layer 34 exhibits twice the susceptance as outer and inner skin layers 36 and 38.

Susceptance b is a function of the dielectric constant of the material (∈), its thickness (t), and the frequency (f) or wavelength (λ=1/f) of interest thus:

$$b \approx 2\pi(f)(t)(\text{Å}-1)/c \qquad (1)$$

where c is the velocity of light in free space and the skin susceptance is normalized by that of free space.

If all the skin layers have the same dielectric constant, then in order for the intermediate skin layer 34 to exhibit twice the susceptance as the outer and inner skin layers 36 and 38, the intermediate skin layer 34 must be twice as thick as outer and inner skin layers 36 and 38. The result, however, is a heavier C-sandwich radome structure.

Figure 5:
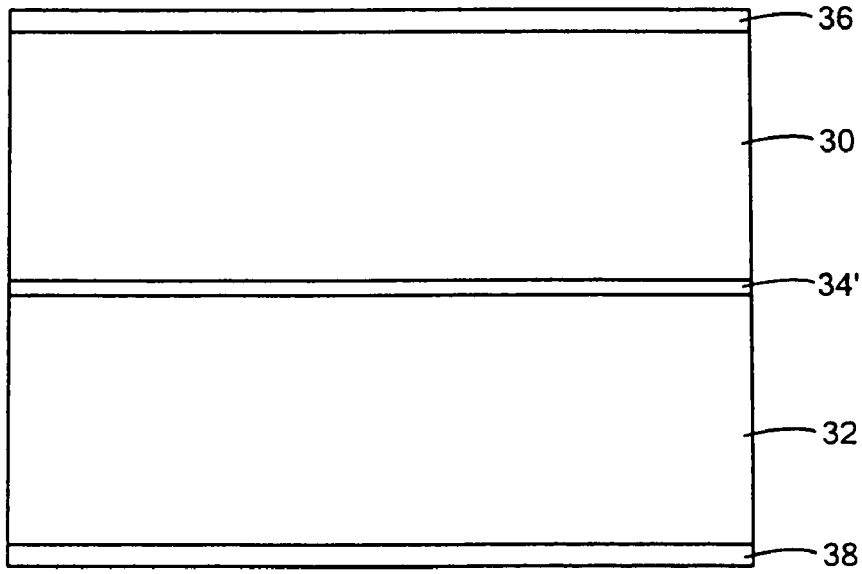
FIG. 5 is a highly schematic cross-sectional view of an example of a C-sandwich radome structure wall in accordance with the subject invention.

In the subject invention, in contrast, a weight reduction on the order of 30% is realized by increasing the dielectric constant of intermediate skin layer 34', FIG. 5 and making it only as thick or even preferably less than, such as half as thick, as outer and inner skin layers 36 and 38. A cost savings is also realized in material and labor costs. When glass fibers are used instead of quartz for the reinforcement of intermediate layer 34', an even further cost savings is realized.

In one example, outer skin layer 36 and inner skin layer 38 are each 20 mils thick and each exhibit a dielectric constant of about 3.5 and the intermediate skin layer 34' can be made only about 10 mils thick if it has a dielectric constant of 11 and yet the susceptance of the intermediate skin layer is still approximately twice the susceptance of both the outer 36 and inner 38 skin layers. Thus, the material of intermediate skin layer 34' includes a dielectric constant enhancer. In one example, intermediate skin layer 34' includes a single ply of woven fabric or other type of reinforcement. Glass or quartz fibers may be used. Glass fibers are preferred because of their lower cost, higher dielectric constant (6.1 as compared to 3.8 for quartz), and reinforcement properties. The resin matrix is typically epoxy, cyanate ester, or bismaleimide for high temperature applications. High dielectric powders such as titanium dioxide, strontium titanate, or barium titanate are added to the resin before the fabric is pre-impregnated with the resin to raise the dielectric constant of the resulting intermediate skin layer 34' to between 8 and 14, typically 11. Other types of high dielectric powers can also be used. Because of the thinner intermediate skin layer (e.g., between 10 to 20 mil thick in one example), a crucial weight saving is realized and yet the susceptance of the intermediate skin layer is still approximately twice the susceptance of each the outer and inner skin layers 36 and 38 due to the higher dielectric constant of intermediate skin layer 34'. The high dielectric powders do weaken the resin matrix somewhat but since intermediate skin layer 34' typically lies in the neutral axis of the radome wall, its strength is not a critical factor. In one example where the high dielectric powders were added to the resin and glass fibers were used as the reinforcement for the intermediate skin layer, the thickness of the intermediate layer was reduced by one third and the weight was reduced by one tenth.

In general, if outer skin 36 and inner skin 38 each have a thickness t and a susceptance b, the intermediate skin layer 34' has a susceptance of approximately twice b but a thickness of less than or equal to t.

Typical materials for core layers 30 and 32 include honeycomb and other low density but strong materials having a nominal thickness of approximately ¼ wavelength of the frequency of interest. The outer skin layer 36 and the inner skin layer 38 are typically identical and include 2 to 4 plies of reinforcement such as woven quartz or glass fibers in a resin matrix resulting in skin layers between 10-30 mils, e.g., 20 mils thick. Quartz is preferred for the reinforcement fibers of the outer and inner skin layers for electrical reasons. The resin used is typically epoxy, cyanate ester, or bismaleimide. The dielectric constant of the inner and outer skin layers is typically between 3 to 5 and in one example was 3.5.

The result is a C-sandwich radome structure which weighs less than prior art C-sandwich radome structures and yet, although lighter, it still exhibits good electrical properties and structural integrity. The central or intermediate skin layer can be less thick than the inner and outer skin layers and yet it still exhibits a susceptance approximately twice the susceptance of the inner and outer skin layers. In this way, the intermediate skin layer of a C-sandwich radome structure can be made thinner and thus lighter but still have the desired susceptance by raising the dielectric constant of the intermediate skin layer. Typically, for a composite material intermediate skin layer, high dielectric powders are added to the resin of the composite to increase the dielectric constant of the resulting intermediate skin layer. The use of glass as opposed to quartz fibers for the reinforcement of the intermediate skin layer results in an even less costly, lighter radome.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A C-sandwich radome structure comprising:

a first core;

an outer skin layer on the first core;

a second core;

an inner skin layer on the second core; and an intermediate skin layer between the first core and the second core, the intermediate skin layer including a resin and a dielectric enhancer for raising the dielectric constant of the resin of the intermediate skin layer so the intermediate skin layer can be made thinner to reduce the weight of the structure.

2. The C-sandwich radome structure of claim 1 in which the intermediate skin layer includes the resin and the dielectric enhancer includes high dielectric powders in the resin.

3. The C-sandwich radome structure of claim 2 in which the resin is an epoxy, cyanate ester, or bismaleimide.

4. The C-sandwich radome structure of claim 2 in which the powders are titanium dioxide, strontium titanate, or barium titanate.

5. The C-sandwich radome structure of claim 2 in which the intermediate skin layer further includes reinforcing fibers.

6. The C-sandwich radome structure of claim 5 in which the fibers are glass fibers.

7. The C-sandwich radome structure of claim 1 in which the intermediate skin layer is between 10 to 20 mils in thickness.

8. The C-sandwich radome structure of claim 1 in which the intermediate skin layer is less thick than the inner skin layer and the outer skin layer.

9. The C-sandwich radome structure of claim 8 in which the outer skin layer and the inner skin layer each have a thickness t and the intermediate skin has a thickness approximately t/2.

10. The C-sandwich radome structure of claim 1 in which the intermediate skin layer has a dielectric constant of between 8 to 14.

11. The C-sandwich radome structure of claim 10 in which the intermediate skin layer has a dielectric constant of approximately 11.

12. The C-sandwich radome structure of claim 1 in which the first and second cores comprise honeycomb material.

13. The C-sandwich radome structure of claim 1 in which the first and second cores each have a thickness of approximately ¼ the wavelength of a frequency of interest.

14. The C-sandwich radome structure of claim 1 in which the outer and inner skin layers each comprise plies of woven fabric in a resin matrix.

15. The C-sandwich radome structure of claim 14 in which there are between 2 to 4 plies.

16. The C-sandwich radome structure of claim 14 in which the resin is an epoxy, cyanate ester, bismaleimide.

17. The C-sandwich radome structure of claim 1 in which the outer and inner skin layers each have a dielectric constant of between 2 to 5.

18. The C-sandwich radome structure of claim 17 in which the outer and inner skin layers each have a dielectric constant of approximately 3.5.

19. The C-sandwich radome structure of claim 1 in which the outer and inner skin layers have a thickness of between 10 to 30 mils.

20. The C-sandwich radome structure of claim 19 in which the outer and inner skin layers each have a thickness of approximately 20 mils.

21. A C-sandwich radome structure comprising:

a first core;

an outer skin layer on the first core having a thickness t and a dielectric constant resulting in a susceptance b;

a second core;

an inner skin layer on the second core having the same thickness t and a dielectric constant resulting in the susceptance b; and an intermediate skin layer between the first core and the second core having a susceptance of approximately twice b but a thickness less than or equal to t.

22. A C-sandwich radome structure comprising:

a first core;

an outer skin layer on the first core;

a second core;

an inner skin layer on the second core; and a resin based intermediate skin layer between the first core and the second core and including a resin and ceramic powders therein for raising the dielectric constant of the resin of the intermediate skin layer so the intermediate skin layer can be made thinner to reduce the weight of the structure.

23. A method of making a C-sandwich radome structure, the method comprising:

forming an intermediate skin layer to include a resin and a dielectric enhancer;

placing the intermediate skin layer between a first core and a second core; and assembling an outer skin layer onto the first core and an inner skin layer onto the second core.

24. The method of claim 23 in which the intermediate skin layer is made to have a susceptance approximately twice the susceptance of the inner skin layer and the outer skin layer but with a thickness less than or equal to the thickness of the inner skin layer and the outer skin layer.

25. The method of claim 23 in which the intermediate skin layer includes the resin and the dielectric enhancer includes high dielectric powders disposed in the resin.

26. The method of claim 25 in which the resin is an epoxy, cyanate ester, or bismaleimide.

27. The method of claim 25 in which the ceramic powders are titanium dioxide, strontium titanate, or barium titanate.

28. The method of claim 25 in which the intermediate skin layer includes reinforcing fibers.

29. The method of claim 28 in which the fibers are glass fibers.

30. The method of claim 23 in which the intermediate skin layer is between 10 to 20 mils in thickness.

31. The method of claim 23 in which the intermediate skin layer is less thick than the inner skin layer and the outer skin layer.

32. The method of claim 31 in which outer skin layer and the inner skin layer each have a thickness t and the intermediate skin layer has a thickness approximately t/2.

33. The method of claim 23 in which the intermediate skin layer has a dielectric constant of between 8 to 14.

34. The method of claim 33 in which the intermediate skin layer has a dielectric constant of approximately 11.

35. The method of claim 23 in which the first and second cores comprise honeycomb material.

36. The method of claim 23 in which the first and second cores each have a thickness of approximately ¼ the wavelength of a frequency of interest.

37. The method of claim 23 in which the outer and inner skin layers each comprise plies of woven fabric in a resin matrix.

38. The method of claim 23 in which there are between 2 to 4 plies in each of the outer and inner skin layers.

39. The method of claim 37 in which the resin is an epoxy, cyanate ester, or bismaleimide.

40. The method of claim 23 in which the outer and inner skin layers each have a dielectric constant of between 2 to 5.

41. The method of claim 40 in which the outer and inner skin layers each have a dielectric constant of approximately 3.5.

42. The method of claim 23 in which the outer and inner skin layers have a thickness of between 10 to 30 mils.

43. The method of claim 42 in which the outer and inner skin layers each have a thickness of approximately 20 mils.

* * * * *